United States Patent [19]

Epina et al.

[11] 3,978,546

[45] Sept. 7, 1976

[54] APPARATUS FOR CLEANING BACK SURFACE OF MAGNETIC TAPE

[75] Inventors: August P. Epina, Boulder; Dennis R. Olmsted, Broomfield; Sanford Platter; Robert J. Jones, both of Boulder; Jack L. Marion, Lafayette, all of Colo.

[73] Assignee: Storage Technology Corporation, Louisville, Colo.

[22] Filed: Apr. 3, 1975

[21] Appl. No.: 564,683

[52] U.S. Cl. ..... 15/306 A; 15/309

[51] Int. Cl.[2] ..... B08B 5/04

[58] Field of Search ..... 15/100, 303, 306 A, 15/308, 309

[56] References Cited

UNITED STATES PATENTS

| | | | |
|---|---|---|---|
| 1,623,528 | 4/1927 | Moos | 15/306 A X |
| 3,091,794 | 6/1963 | Pillsbury, Jr. | 15/308 |
| 3,475,782 | 11/1969 | Teuber | 15/308 |
| 3,745,602 | 7/1973 | Beistle | 15/308 |

*Primary Examiner*—Christopher K. Moore
*Attorney, Agent, or Firm*—Woodcock Washburn Kurtz & Mackiewicz

[57] ABSTRACT

A rotatable cleaning element having a resilient, porous material disposed on the outer surface thereof is mounted in a foil bearing so that the surface of the porous material protrudes above the bearing surface. The interior of the bearing is maintained at a negative pressure, and a jet of pressurized air disposed within the rotatable element. When magnetic tape is transported over the bearing surface, the tape makes contact with and slightly compresses the porous material. As the cleaning element rotates successive areas of the porous material is brought into contact with the tape. Compression of the material causes the pores thereof to expand slightly, and engage foreign material on the tape surface. The pores contract as the material breaks contact with the tape to encapture the foreign material. The foreign matter thus accumulated is subsequently blown free of the porous material by a jet of air directed from within the rotatable body.

11 Claims, 3 Drawing Figures

APPARATUS FOR CLEANING BACK SURFACE OF MAGNETIC TAPE

BACKGROUND OF THE INVENTION

The present invention relates to transport mechanisms for magnetic tape, and more particularly to means for removing accumulated impurities from the surface of a rapidly moving length of tape.

In some state of the art apparatus using magnetic tape, the need for removing accumulated impurities from the coated or magnetic surface thereof has been recognized and means provided for removing the impurities. Such means commonly take the form of rigid elements which contact the passing tape and scrape foreign substances from the front or coated tape surface.

While such cleaning devices have generally been acceptable in the past, newer digital equipment of the high density type is much more sensitive to the presence of foreign matter on the tape surface. Foreign substances often cause an increased separation between the surface of the tape and the reading or writing heads, which separation causes the heads to "skip" an area of the tape. In previous digital tape systems, a certain degree of skip could be tolerated due to the relatively large area of the tape occupied by individual regions of flux signals, or "bits" and the greater separation that can be tolerated (e.g. 200 microinches as compared with 70 microinches for the high density apparatus). With the advent of high density recording, however, the individual magnetized regions of the tape are much smaller so that even small particles of foreign matter on the tape surface can give rise to substantial and unacceptable gaps between the tape and the reading or writing transducers.

While it has been recognized that one source of foreign matter has been the uncoated or back side of the tape which, of course, comes into contact with the oxide coated surface when the tape is wound on a reel, no cleaning mechanisms have been devised for incorporation into digital tape transport equipment. Moreover, existing cleaning devices are not adaptable for cleaning the uncoated back surfaces of present tape materials. Not only are the tape back surfaces more susceptible of scoring or scratching, but the amount of foreign material which is accumulated upon the back surfaces is such as to cause an unacceptably large buildup of matter in the prior art cleaning devices. This rapidly renders the cleaning operation ineffective and may ultimately cause large accumulations of foreign matter to be transferred back to the tape.

It is therefore an object of the present invention to provide a device for cleaning the uncoated surface of a transported tape element.

It is another object of the invention to provide an improved apparatus for removing foreign material from the surface of a passing tape element.

Still another object of the invention is to provide a device for cleaning the surface of a tape element, which does not scrape or abrade the tape surface.

SUMMARY OF THE INVENTION

In accordance with one embodiment of the present invention, the above objects are achieved by providing a rotatable cleaning element journaled up suitable bearing means and having a resilient, porous surface. A hydrostatic or hydrodynamic foil bearing is disposed on either side of the cleaning element for supporting a transported tape in interfering relationship with the porous portion of the cleaning element. As the tape passes over the bearing, the cleaning element rotates, the porous portion thereof being compressed as it encounters the tape surface. As a consequence, the pores thereof expand, and later contract as contact with the tape ceases. In this manner, the pores engage and capture foreign materials, which are subsequently discharged from the porous surface by a jet of air directed from within the rotating element.

In another embodiment of the invention, a low pressure region is used to bring the tape against the cleaning element and scraping blade disposed adjacent the element. This is used to clean the oxide side of the magnetic tape.

BRIEF DESCRIPTION OF THE DRAWINGS

While the specification concludes with claims particularly pointing out and distinctly claiming the subject matter which is regarded as the invention, the present invention will be better understood by making reference to the accompanying drawings in which:

DESCRIPTION OF A PREFERRED EMBODIMENT

Figure 1:
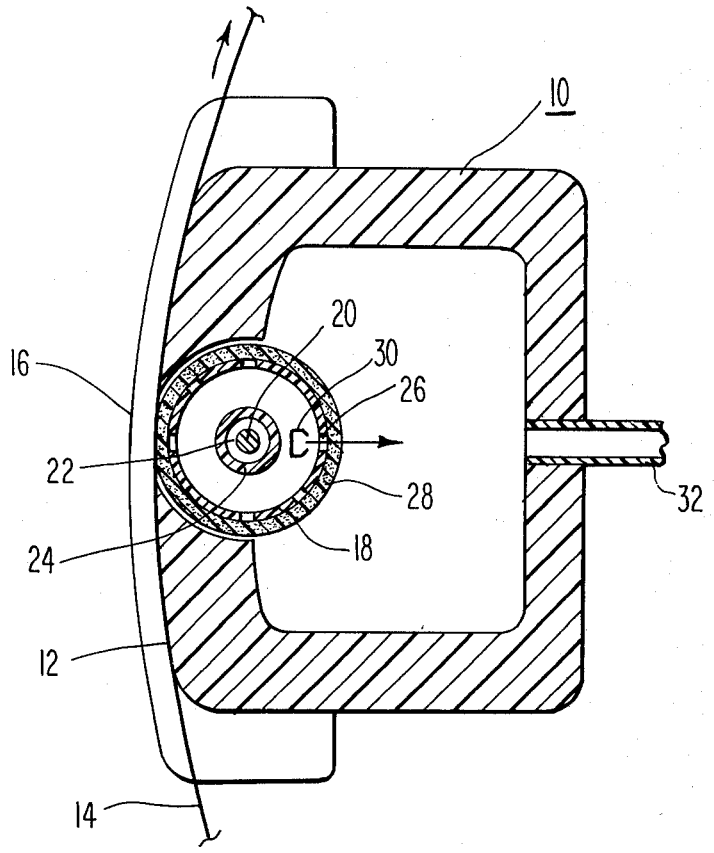
FIG. 1 is a partially sectioned view of one embodiment of the invention.

FIG. 1 shows, in partially sectioned form, one version of the inventive apparatus including a foil bearing generally indicated at 10.

Such bearings are well known to those skilled in the art, and comprise a smooth wear resistant surface 12 over which a length of foil or tape 14 is transported. The relative movement between the tape and bearing surface gives rise to a gap comprising a thin layer of air beneath the tape in the manner of a hydrodynamic bearing. It will be appreciated that the layer of air is extremely thin, on the order of 150 microinches, and is exaggerated in FIG. 1 for purposes of description. A pair of guide flanges, of which only flange 16 is visible, are disposed at opposite sides of the bearing surface for guiding the tape and positioning it upon the bearing.

Within the body of the bearing is disposed a cylinder 18 which is rotatably mounted upon a shaft 20 by means of a suitable bearings 22. In one successfully tested embodiment, the cylinder has formed therein a coaxial sleeve 24, in which are disposed a pair of small ball bearings. Alternatively, a bushing of appropriate material may be fitted within sleeve 24, or a gas bearing arrangement could be used. Still another approach might be to provide a coaxial member extending outwardly from one end of cylinder 18 and supported in appropriate bearings.

A plurality of openings such as that indicated at 26 are formed in the lateral wall of cylinder 18, and in a preferred embodiment extend over most of the axial length of the cylinder. Disposed about cylinder 18 is a layer of porous, resilient material 28. By porous is meant a material of the open-cell having continuous, interconnecting openings such that fluids or gases may pass freely therethrough. In a preferred form, layer 28 is a reticulated polyurethane foam material having 60 pores per square inch. The individual pores are relatively large so that the body material of the foam element has the appearance of interwoven strands or fibers. One such material appropriate for use in the described apparatus is a reticulated polyurethane foam available from the Foam Division of the Scott Paper Co. of Chester, Pa.

In order to extend the life of the reticulated foam material, it has been found advantageous to coat the fibrous matrix with liquid polyurethane. The liquid is thinned to the necessary degree with an appropriate solvent, and applied to the foam in any convenient manner to cause the liquid to wet the surface of the fibrous members without substantially reducing the size of the pores. It is believed that, due to the effect of surface tension, the coating material tends to fill tiny flaws which otherwise reduce the cross-sectional area of the individual fibers and weaken them so that they fail under repeated flexure.

Cylinder 18 is located so that as tape 14 passes over bearing surfaces 12, it contacts foam layer 28 and compresses it slightly. The degree of compression of the foam is a function of the location of cylinder 18, the tension exerted upon tape 14 and the resiliency of the foam layer 28. It has been found that by compressing the foam, the pores thereof are enlarged so that the portion of foam layer 28 which is in intimate contact with the back surface of tape 14 has larger pore openings than do the other portions of the layer. As cylinder and associated foam layer rotate, the foam then passes out of contact with the tape and the previously enlarged pores contract. In this manner, the foam element "scrubs" the tape surface and encaptures foreign material from the tape. The material thus entrained in the foam remains therein as the cylinder rotates, and is subsequently forced outwardly from the foam by a jet of air issuing from a duct 30.

In a preferred embodiment, duct 30 extends axially within cylinder 18 and has an elongate lateral opening which produces a jet of high pressure air along the inner surface of the cylinder. The air which may be supplied from any convenient source, then blows through the passing foam as indicated by the arrow in FIG. 1. A source of negative pressure is coupled to the interior of the bearing body by means of tube 32. The negative pressure assists in the removal of foreign matter from the foam element 28, and transports the unwanted particulate matter away from the region about cylinder 18.

Figure 2:
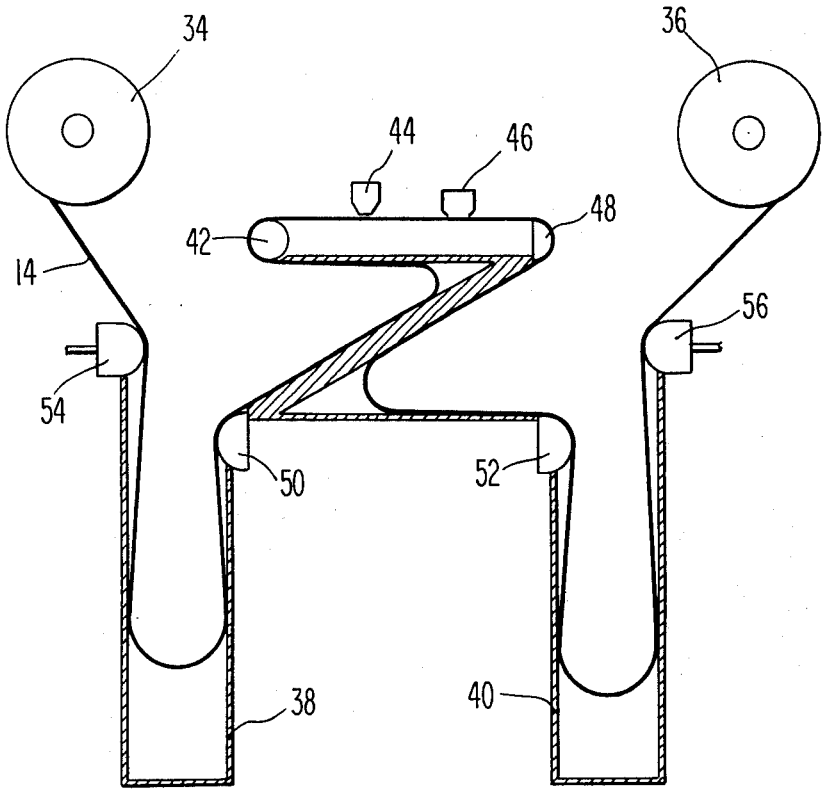
FIG. 2 shows the inventive apparatus in conjunction with a typical tape transport system.

Referring now to FIG. 2, there is shown a typical tape drive system including tape reels 34 and 36, and buffer columns 38, 40. A capstan 42 frictionally engages tape 14 and drives the tape in either a forward or a reverse direction, as required for the operation of the system. A read/write head 44 is disposed in close proximity to the front side of the tape, as is a tape cleaning apparatus 46. Cleaner 46 may be one of the several types known in the prior art, or may be constructed in accordance with the teachings of copending patent application Ser. No. 564,684, filed Apr. 3, 1975. As is customarily the case bearings 48, 50 and 52 are provided at points where the direction of tape 14 is to be changed. These bearings may comprise hydrodynamic foil bearings, or bearings of any other appropriate type.

Positioned at the outer extremities of buffer columns 38 and 40 are additional bearings 54 and 56, respectively. The latter bearings are constructed according to the embodiment of FIG. 1, and serve to remove foreign material from the back surface of tape 14 immediately before the tape is taken up upon a reel. In the FIGURE, two back surface cleaners are used as it is understood that the tape 14 may be transported in both a forward and a reverse direction. In order that the cleaning of the back surface take place as close as possible to the reel serving as the takeup reel, it is thus necessary to provide two cleaning units, each in close proximity to one of the reels. Although in the illustrated embodiment, the cleaning units are disposed at the upper ends of the buffer columns, it will be understood that this location is a matter of convenience and may be varied to suit individual applications.

Figure 3:
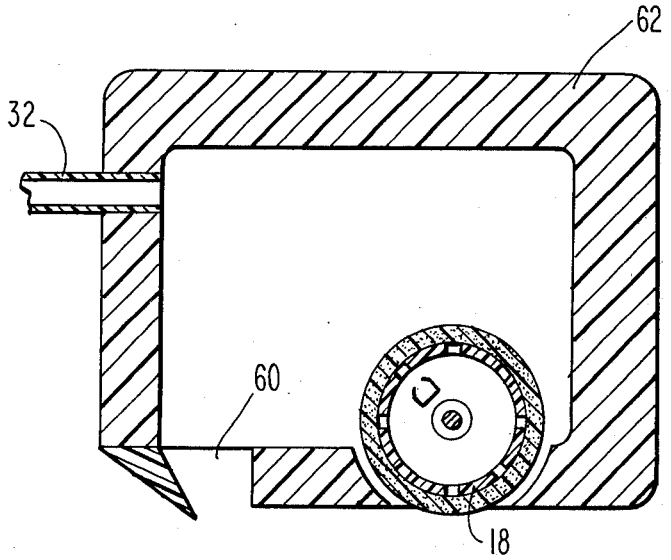
FIG. 3 is another embodiment of the invention.

FIG. 3 shows a modified embodiment of the present invention in which an opening 60 is formed in the body of a housing 62, in which foam-covered cylinder 18 is journaled. A scraper blade 64 is attached to the housing and disposed so as to remove foreign material from the front or oxide surface of a passing length of tape. While the foam-covered cylinder 18 serves to remove loose particulate foreign matter, and troublesome viscous foreign material, the scraper blade serves to dislodge foreign material which is firmly adhered to the surface of the passing tape. Although oxide-surface cleaners using scraper blades are known in the prior art, the combination of the scraping action in conjunction with the pickup and subsequent discharge of foreign matter by the foam surface of cylinder 18 provides superior cleaning of the tape surface. As in the case of FIG. 1, a tube 32 is coupled to a source of negative pressure both to aid in removing foreign matter and to draw the passing tape against the working surfaces of the apparatus.

As will be evident from the foregoing description, certain aspects of the invention are not limited to the particular details of the examples illustrated, and it is therefore contemplated that other modifications or applications will occur to those skilled in the art. It is accordingly intended that the appended claims shall cover all such modifications and applications as do not depart from the true spirit and scope of the invention.

What is claimed as new and desired to be secured by letters patent of the United States is:

1. Apparatus for removing foreign matter from the surface of an elongate moving tape, comprising:

support means;

a generally cylindrical cleaning element rotatably disposed in said support means, said cleaning element having a porous, resilient outer surface layer;

means for urging the surface of a moving tape against said cleaning element to effect rotation of said element and to compress said resilient outer surface layer, whereby the pores of said surface layer are caused to expand and engage foreign matter disposed upon the surface of said tape, rotation of said element serving to transport the engaged foreign matter away from the surface of said tape; and duct means disposed within said cleaning element for directing a jet of air upon said surface layer from within to dislodge foreign matter therefrom.

2. The invention defined in claim 1, wherein said support means comprises bearing surfaces for hydrodynamically supporting a moving tape thereon, said surfaces being disposed at either side of said cleaning means.

3. The invention defined in claim 2, wherein the interior of said support means defines a cavity at least a part of the cleaning element lying within said cavity, and means for coupling said cavity to a source of negative pressure.

4. The invention defined in claim 3 wherein said duct means is oriented to dislodge said foreign matter into said cavity.

5. Apparatus for removing foreign matter from the back surface of a length of moving magnetic tape, comprising:

a foil bearing having surfaces for hydrodynamically supporting the moving tape thereon;

cleaning means rotatably journaled within said foil bearing, said cleaning means comprising a rigid cylindrical member having at least one aperture in the outer surface thereof and a layer of resilient, porous material disposed upon said outer surface of said cylindrical member, said member being so located within said foil bearing that said porous material extends above said surfaces of said foil bearing to bear upon the back surface of the moving tape and engage foreign matter on the tape surface, rotation of the cleaning means serving to transport the engaged foreign matter away from the surface of the tape; and duct means disposed within said cylindrical member for directing a stream of air through said at least one aperture upon the peripherally inner surface of said porous material.

6. The invention defined in claim 5, wherein said foil bearing defines a cavity therewithin, said porous material being at least partially disposed within said cavity, and means for coupling said cavity to a source of negative pressure.

7. The invention defined in claim 6 wherein said cylindrical member is provided with a plurality of apertures in the outer wall thereof.

8. The invention defined in claim 7 wherein said porous material is reticulated polyurethane foam.

9. The invention defined in claim 8, further including flange means extending from said foil bearing, generally parallel to and upon either side of the path of the tape over the surfaces of said bearing.

10. The invention defined in claim 9, further including a solidified layer of polyurethane disposed over the polyurethane of said porous material for reinforcing the material which defines the pores.

11. Apparatus for removing foreign matter from a surface of a length of moving magnetic tape, comprising:

a substantially rigid body means defining a cavity therein and adapted to be mounted adjacent the path of the tape;

a cylindrical cleaning means for bearing against the surface of the tape and rotatably mounted in said body, at least part of said cleaning means extending within said cavity, said cleaning means having a resilient, porous outer surface for engaging foreign matter disposed on the surface of the tape;

blade means attached to said body means in spaced relationship to said cleaning means and having a sharpened edge oriented in the path of the tape for scraping foreign matter from the surface of the tape;

said body means defining an aperture between said blade means and said cleaning means; and means for coupling said cavity to a source of negative pressure.

* * * * *

PO-1050
(5/69)

UNITED STATES PATENT OFFICE
CERTIFICATE OF CORRECTION

Patent No. 3,978,546 Dated Sept. 7, 1976

Inventor(s) August P. Epina et al.

It is certified that error appears in the above-identified patent and that said Letters Patent are hereby corrected as shown below:

In the Abstract, line 16, "material" should be --matter--.

Col. 1, line 66, "up" should be --in--.

Col. 3, line 26, after "As" the word --the-- should be inserted;

line 38, after "air" there should be a comma --,--.

Signed and Sealed this

Twenty-third Day of November 1976

[SEAL]

*Attest:*

RUTH C. MASON
*Attesting Officer*

C. MARSHALL DANN
*Commissioner of Patents and Trademarks*